US008176765B2

(12) United States Patent
Choe

(10) Patent No.: US 8,176,765 B2
(45) Date of Patent: May 15, 2012

(54) DIE ASSEMBLY AND A METHOD OF MAKING IT

(75) Inventor: Sung Gi Choe, Pyongyang (KP)

(73) Assignee: Sung Gi Choe, Pyongyang (KR)

( * ) Notice: Subject to any disclaimer, the term of this patent is extended or adjusted under 35 U.S.C. 154(b) by 509 days.

(21) Appl. No.: 12/373,782

(22) PCT Filed: Jul. 15, 2007

(86) PCT No.: PCT/KP2007/000010

§ 371 (c)(1),
(2), (4) Date: Jan. 14, 2009

(87) PCT Pub. No.: WO2008/010614

PCT Pub. Date: Jan. 24, 2008

(65) Prior Publication Data

US 2009/0314050 A1 Dec. 24, 2009

(30) Foreign Application Priority Data

Jul. 17, 2006 (KP) ..... 06-249

(51) Int. Cl.
*B21C 3/02* (2006.01)

(52) U.S. Cl. ..... 72/467; 72/274; 76/107.4

(58) Field of Classification Search ..... 72/274, 72/278, 467, 468, 478; 76/107.4
See application file for complete search history.

(56) References Cited

U.S. PATENT DOCUMENTS

| | | | | |
|---|---|---|---|---|
| 1,935,821 | A * | 11/1933 | Simons | 72/467 |
| 2,150,734 | A * | 3/1939 | Unckel | 72/467 |
| 3,628,370 | A | 12/1971 | Phillips, Jr. | |
| 7,131,314 | B2 * | 11/2006 | Yoshida et al. | 72/467 |
| 7,540,181 | B1 * | 6/2009 | Memmott | 72/467 |

FOREIGN PATENT DOCUMENTS

DE 43 11 249 10/1994

* cited by examiner

*Primary Examiner* — David Jones
(74) *Attorney, Agent, or Firm* — Gifford, Krass, Sprinkle, Anderson & Citkowski, P.C.

(57) ABSTRACT

The present invention provides a novel die assembly for extruding and drawing ferrous and non-ferrous metal, and also to a method of making the same. The die assembly according to the present invention comprises a die core (3); at least one pre-stressed ring (2) placed around the die core (3); and a die casing (1) surrounding the ring (2), wherein the ring (2) is plastically deformed and hardened by press fitting it to the casing (1) so that the ring has compression stress exceeding its material yield limit by 10-40%, and the mating geometric feature (5) of the core and the ring is tapered towards the exit, to thereby obtain a rigid container system in which a die core can be press fitted with a great force without die cracking. As a result, a long lasting die assembly with surprisingly high performance, small dimension and low production cost is obtained by assembling the die core by a great force without die cracking.

10 Claims, 2 Drawing Sheets

DIE ASSEMBLY AND A METHOD OF MAKING IT

CROSS-REFERENCE TO RELATED APPLICATIONS

This application is the U.S. national phase of PCT/KP2007/000010 filed Jul. 15, 2007, which claims priority of Korean Patent Application No. KP-06-249 filed Jul. 17, 2006.

FIELD OF THE INVENTION

The present invention generally relates to a novel die assembly for extruding and drawing ferrous and non-ferrous metal, and also to a method of making the same.

BACKGROUND OF THE INVENTION

Since a die was first invented, no innovative changes have been made in its structure; it has been improved only in the aspect of its material and now came to a state, where coating technique was combined. Structural innovation that enables reduction of production cost and improvement of operational capabilities is highly important in the art. It is to develop a novel die container system with high strength and a safe method of assembling die core to such system by a great force.

The U.S. Pat. No. 4,270,380 provides a die assembly having an interlayer between a die nib and a casing composed of all-crystalline ceramic material having a heating liquidus temperature within the range of 500° C.-570° C. The solidified interlayer maintains uniform shrink-fitted compression on the nib during usage of the assembly, and thus makes it possible to overcome die cracking, its operational capability being improved.

International Patent Application WO 2005058519 describes a diamond die having a die core and at least two pre-stressed rings housing the die core and a method of making the same. The rings may be shrink fit, press-fit, or otherwise formed around each other such that elastic and plastic deformation occurs and the rings are at near yield state, but not yielded state.

A die having an interlayer between the die core and the casing is also explained in Russian Patent No. 1477497, which is characterized in that the yield strength of the interlayer material is 0.5-0.9 times that of the casing material. An interlayer with 0.25 mm thickness is formed by dipping the core in the dissolved interlayer material. The die core coated with interlayer is then shrink-fitted to the pre-heated casing, the inside surface of which is threaded to a meta screw using a chaser prior to fitting. As a result, an easily removable die with longer life time is obtained.

By utilizing the die casings and assembling methods that have been known until now, it is impossible to considerably improve its operational capabilities by fitting the die core with a great force and prevent die cracking when fitting the light weight die core with a great force.

If a die made of wear-resistant materials like hard alloy and extra hard alloy having low tensile strength and high compression strength is assembled by a great force in a safe mode without cracking the die core, its operating capability would be significantly improved.

The aim of the present invention is to attain a long lasting die assembly with an improved operational capability by providing a rigid die container system with great strength and a new method of assembling the die core to it by a great force without die cracking.

SUMMARY OF THE INVENTION

A die assembly provided by the present invention comprises a die core; at least one pre-stressed ring placed around the die core; and a die casing surrounding the ring. The ring is plastically deformed and hardened via compression stress exceeding its material yield limit, and the mating geometric feature of the core and the ring is tapered towards the exit.

According to the present invention, die core material is selected preferably from hard alloy, extra hard alloy, nitride, carbide, man-made diamond or combination of them.

In an embodiment of the present invention, the die casing material is selected from steel or alloy steel with hardness preferably in the range of HRC 40-55.

In a preferred embodiment of the present invention, the pre-stressed ring has the dimensionless thickness $D_2/d_2$ of 1.15-1.3, in which $D_2$ and $d_2$ are respectively outer and inner diameter of the ring.

According to the present invention, ring material is selected preferably from steel, alloy steel or ferrous/non-ferrous metal alloy of the same strength and plastic deformation characteristics as those of steel and alloy steel, its hardness preferably being in the range of HRC 30-45.

In an embodiment, the mating geometrical feature of the die and the ring is tapered towards the exit at an angle of 1-3°.

The present invention also provides a method of forming a die assembly according to the present invention comprising steps of:

a) grinding of the tapered outer surface of the die;
b) machining and heat-treating of the ring and the die casing, and grinding or finish-machining of interface between the casing and the ring;
c) plastically press-fitting the ring to the inner surface of the die casing such that the ring has compression stress exceeding its material yield strength by 10-40%;
d) machining of the inner surface of the press-fitted ring to a taper fitted to the taper of the die core;
e) press-fitting of the die core to the tapered inner surface of the ring.

According to the present invention, in step a) the die core is ground or finish-machined to the outer surface roughness of Ra 1.25 or more.

In an embodiment of the present invention, in step b) the interface of the casing and the ring is ground or finish-machined to the roughness of Ra 2.5 or more.

In step d) the inner surface of the ring may be ground or finish-machined to the roughness of Ra 2.5 or more.

The present invention, with its unique die container system and novel method of assembling the core to the system by a great force without die cracking, makes it possible to provide a long lasting die assembly with surprisingly high performance, lower production cost and smaller dimension.

DETAILED DESCRIPTION OF THE INVENTION

An Improved Die Container System with High Strength

It is generally known to those skilled in the art that the working pressure formed on the die container with a single cylinder is at most half of material yield strength; when the container has more than one casings, the working pressure is more than half of material yield strength, which is expressed by the formula (1)

$$P = \frac{\sigma_S n\left(K^{\frac{2}{n}} - 1\right)}{2K^{\frac{2}{n}}} \quad (1)$$

wherein $\sigma_s$ denotes yield strength of cylindrical casing material; n denotes number of cylinders; K denotes proportion (b/a) of its outer radius b to its inner radius a. According to the above formula, P is $0.5\sigma_s$ for n=1, and P is $0.66\sigma_s$ for n=2.

The formula (1) based on Lame formula corresponds to thick cylindrical container system with more than one cylinder. Container systems of drawing dies designed on the basis of the formula is of large dimensions and hard to be used in practice.

When a relatively thin ring is plastically press-fitted to a thicker cylindrical body, a die container which is particularly high in strength and rigidity, but small in dimensions can be obtained. It was verified by the practice that such die container system is of great effect if used in die assemblies for extruding and drawing and axisymmetric holes, of various sizes and types.

Figure 1:
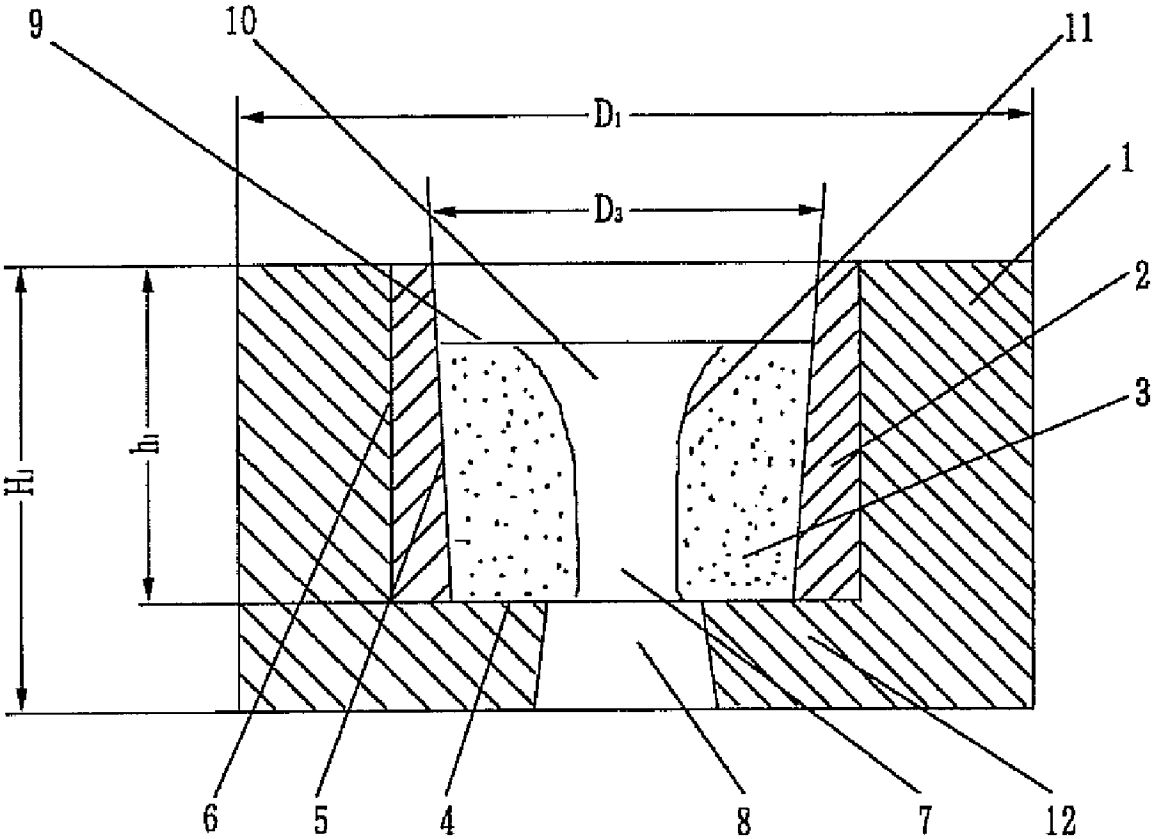
FIG. 1 is a cross-section view of a die assembly according to the present invention, wherein a die core is press-fitted to the ring housed in a casing.

FIG. 1 shows a die assembly according to an embodiment of the present invention wherein a die core is assembled in such a die container. In FIG. 1, 1 indicates cylindrical casing with larger thickness, 2 indicates a ring press-fitted to the casing 1, 3 indicates the die core.

$D_1$ and $H_1$ respectively refer to the outer diameter and the height of the die casing 1; and $d_1$ and $h_1$ refer to the inner diameter and the depth of cavity of the die casing 1 where the die core and the ring are assembled; $D_2$, $d_2$ and $h_1$ respectively refer to outer and inner diameter and height of the ring 2 prior to being fitted to the casing. The bottom 12 of the die casing 1 has sufficient thickness and the opening 8 for discharging the stock is tapered at an angle of 40-45°.

The die container system is comprised of thicker die casing and relatively thinner pre-stressed ring, wherein the dimensionless thickness of the casing 1 is expressed in $\alpha_1=D_1/d_1$, the dimensionless thickness of the ring is expressed in $\alpha_2=D_2/d_2$. $\alpha_1$ is always above 1.6 and $\alpha_2$ is in the range from 1.12 to 1.3.

The casing 1 is made of steel or alloy steel, and the ring 2 is made of steel, alloy steel or ferrous/non-ferrous metal alloy of the same strength and plastic deformation characteristics as those of steel or alloy steel.

To sufficiently increase casing strength and ring's effect, the casing 1 and the ring 2 are heat-treated to a required hardness.

The relatively thinner ring 2 is plastically press-fitted to the thicker casing 1 in such a way that the ring 2 is strain hardened. As a result, while less high tensile stress is created on the die casing 1, higher compression stress is formed on the ring 2, the strength of the casing being increased by 20%.

When ring 2 is press-fitted to the state of plastic deformation with great negative allowance, a compression stress (pre-stress) exceeding its material yield strength is created on the ring 2, under which crystallization of ring metal becomes closer, its strength being increased.

The resulting die container system, with its high strength, makes it possible to fit a die core to the container by a greater force. Besides, due to its small dimensions, it becomes ideal die container.

Fitting of the ring 2 is done by means of a press.

When the casing 1 and the ring 2 are fitted on the interface 6 by a press, the negative allowance is expressed with reference to the diameter by formula (2)

$$\delta_1=D_2-d_1 \quad (2)$$

wherein $D_2$ and $d_1$ respectively denote the outer diameter of the ring 2 and the inner diameter of the casing 1 prior to fitting.

A Novel Method of Assembling.

The present invention also provides a novel assembling mode and mating geometric feature of the core 3 and the container system, which enable minimal chances of die cracking when it is fitted to the system using great force. The mating geometrical feature 5 of the die core 3 and the ring 2 is conically tapered, which results in gradual increase of uniform pressure throughout the mating feature when fining the core 3 into the ring 2. Thus, the die core 3 is safely fitted to the ring 1 without cracking.

Figure 2:
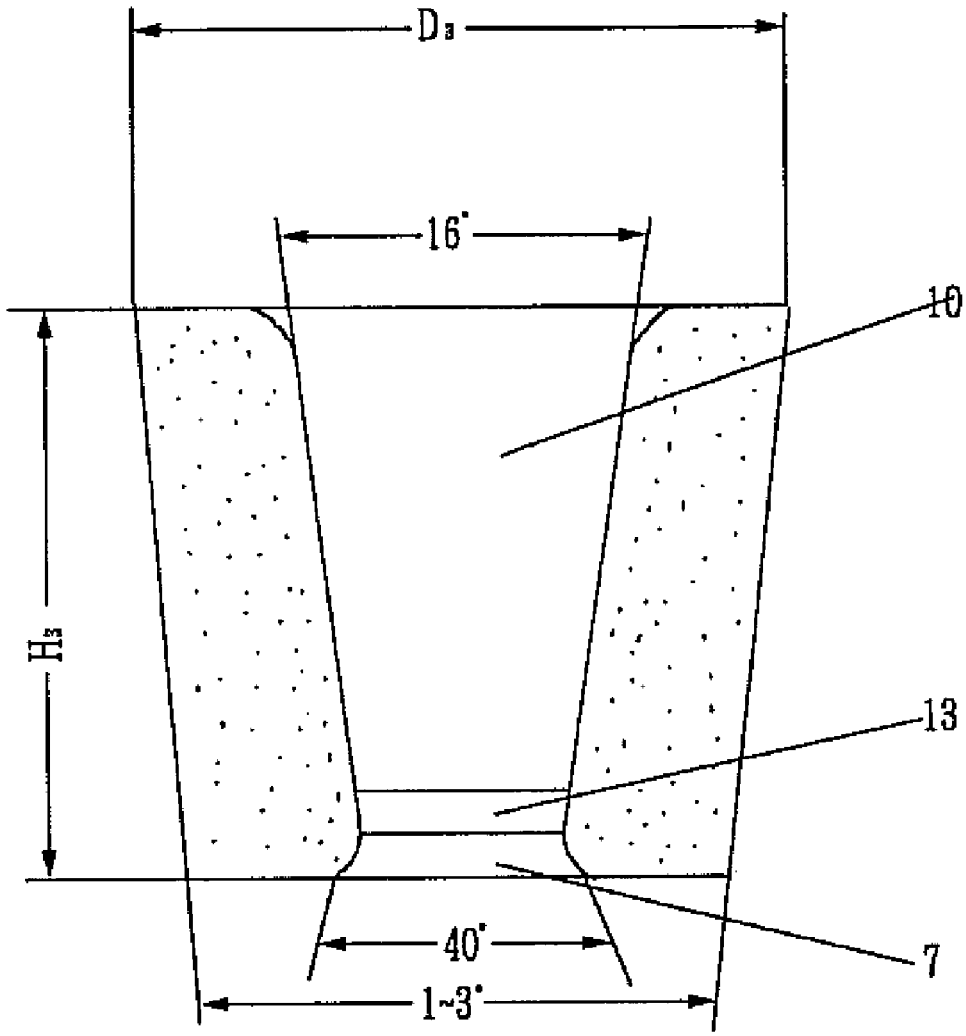
FIG. 2 is a cross-section view of a die core according to the present invention, wherein the outer surface of the core is tapered; numerals 10 and 7 respectively refer to entrance and exit for passage of stock; 13 refers to bearing zone.

The outer surface of the die core is made to be tapered at angle in the range of 1-3° considering dimension of the die core 3, the thickness of the ring 2, working condition and task of die, as shown in FIG. 2.

The outer diameter of upper surface 9 of the die core prior to fitting is indicated by $D_3$, its height by $H_3$, the outer dimension of the core is not bigger than the ISO 1684 (1975) standards.

After the ring 2 is assembled to the casing 1, the inner surface of the ring is finish-machined to a taper fitted to the taper of the die core.

The die core 3 is press-fitted to the tapered inner surface of the ring 2 with a certain negative allowance $\delta_2$ by utilizing a press.

The ring 2 already press-fitted to the casing 1 is once again compressed and hardened between the die core 3 and the casing 1 to be precisely and firmly fitted to die core 3.

The negative allowance of the die core 3 and the ring 2 is expressed with reference to the diameter by formula (3)

$$\delta_2=D_3-d_2', \quad (3)$$

wherein $D_3$ denotes the diameter of the upper surface 9 of the die core; $d_2'$ denotes the inner diameter of the ring 2 at the height $H_3$ from the bottom of the casing cavity when it is machined to a taper that fitted to the taper of the core 3.

The interfaces between the casing 1, the ring 2 and the core 3 are finished by grinding or machining in such a manner that they are precisely fitted with each other.

$\delta_1$ and $\delta_2$ expressed by formulas (2) and (3) are determined referring to material used for the die core and the casing, their structures and dimensions.

Effect of the Ring

To improve operational capability of the die assembly by maximizing ring effect and thus assembling die core by a great force in a safe mode, it is very important to make proper selection of the angle at which the die core is tapered, ring material, its thickness $\alpha_2$, and negative allowances $\delta_1$ and $\delta_2$.

If the die core is tapered at an angle less than 1°, local assembling pressure may occur during assembly. If that angle exceeds 3°, it is difficult to provide required thickness of the ring as the ring thickness prior to fitting is relatively thin.

The value of negative allowance $\delta_1$ is determined such that the ring can be compressed and hardened via a great compression stress exceeding its material yield strength by 10-40%.

The value of negative allowance $\delta_2$ is determined in such a manner that the die core is fitted via compression stress not less than elastic limit.

To take suitable ring material, accurate selection of hardness and thickness of the ring is particularly important for increasing intermediate ring effect. If hardness or rigidity is not high enough, it is impossible to increase the strength of intermediate ring during press-fitting and attain a rigid container with a great pre-stress and strength. If the hardness of the ring is too high, it will lead to die cracking due to imperfection of accuracy in machining and assembling the interfaces.

If dimensionless thickness of the ring $\alpha_2$ is less than 1.12, it is too thin to accomplish high strength and fitting rigidity of the ring. Furthermore, if it is more than 1.3, it is too thick to be compressed and hardened via great compression stress and a light-weight die container can not be obtained.

According to value of $\delta_1$ and $\delta_2$, press-fitting force of the ring $P_1$ and press-fitting force of the core $P_2$ are determined. A reasonable state of deformation via compression stress, which is favorable for improving operational capability of shaping metal, may occur depending on $P_2$.

Since the die container system with pre-stressed ring has high strength, the die core press-fitted by a great force is hardened via high compression stress, which is favorable for die operational capabilities.

Conical interface of the die core 3 and the ring 2 maintains a uniform press-fitted pressure all around the core during assembly, the pressure being gradually increased and thus effectively prevents cracking of die.

The ring 2 permits the die container system to have higher strength as well as long term capability during operation.

During operation of die, the force of bonding core is relaxed by repeated working pressure and heat load, which results in change of die operating capability and fatigue cracking. However, as the inner and outer surfaces of the ring according to the present invention is firmly bond to the casing 1 and the core 3 and deformation in volume of the ring is controlled due to conical outer surface of the core, the bonding force is mainly maintained, which results in long term capability of the die core.

As is shown above, the ring has a surprisingly high effect in increasing the casing strength, preventing die cracking during assembly and improving die capability.

The inner diameter of the casing 1 and the outer diameter of the ring 2 are chamfered prior to press-Fitting, which is favorable for press-fitting.

The casing is made of steel or alloy steel; the ring is made of steel, alloy steel or ferrous/non-ferrous metal alloy having the same strength and plastic deformation characteristics as those of steel or alloy steel.

The casing 1 and the ring 2 are heat-treated at the temperature in the range of 800-900° C., and then oil-cooled and tempered to the hardness of HRC 40-55 of casing and HRC 30-45 of the ring.

The interface between the casing 1 and the ring 2 is finish-machined to the roughness of Ra 2.5 or more, which is followed by press-fitting the ring to the casing with negative allowance $\delta_1$, the interface being lubricated.

After the ring is press-fitted to the casing, the inner diameter is being tapered by grinding or finish-machining it to the roughness of Ra 2.5 or more.

The die core 3 is press-fitted into the ring by a press. The pressing force is imposed until the core reaches the bottom 4 of the casing 1. The interface between the core and the ring is also lubricated.

Example

Table 1 shows dimensions and assembling characteristics of dies of two types. Their casings were composed of alloy steel 40 Cr and heat-treated to the hardness of HRC 42 and 40; their rings were made of alloy steel 20 Cr and heat-treated to the hardness of HRC 35 and 32.

The rings, which were fitted to the casing with negative allowances as shown in Table 1, got compressed and hardened to a state of plastic deformation (compression deformation) exceeding their material yield strengths.

TABLE 1

| | Die core 3 | | | Casing 1 | | | | Ring 2 | | | Negative allowance | |
|---|---|---|---|---|---|---|---|---|---|---|---|---|
| Tested die | $D_3$ (mm) | $H_3$ (mm) | D (mm) | $D_1$ (mm) | $H_1$ (mm) | $h_1$ (mm) | hardness, (HRC) | $D_2$ (mm) | $d_2$ (mm) | hardness (HRC) | $\delta_1$ (mm) | $\delta_2$ (mm) |
| 1 | 22 | 20 | 7.5-0.1 | 48 | 36 | 24 | 42 | 26.4 | 21.5 | 35 | 0.5 | 0.185 |
| 2 | 20 | 17 | 6.5-0.1 | 43 | 32 | 22 | 40 | 23.6 | 19.5 | 32 | 0.4 | 0.174 |

If two or more rings are likewise press-fitted plastically, the strength of the container system can be further increased. Such assembling method can be applied in manufacturing higher pressure equipment such as dies for making boron nitride and diamond.

Method of Making the Die Assembly of the Present Invention

The die core 3 is made of hard alloy or other wear resistant die materials having high compression strength, its outer dimension not exceeding ISO standards 1684. Its outer surface is tapered at an angle in the range of 1-3°. It is ground to the roughness of Ra 1.25 or more.

The core of the present invention may have reasonable inner profiles 11 which are already known to those skilled in the art, that is, circular, elliptical, polygonal, or trapezoidal in shape with rounded corners, to optimally support uniform radial compression for uniform internal stresses.

With respect to $D_3$, the inner diameter of the ring is expressed in $d_2<D_3-\delta_2$, the outer diameter in $D_2=\alpha_2 d_2$. Then the height of the ring is equal to $h_1$; the inner diameter $d_1$ is machined to $\delta_1$ shorter than $D_2$, the outer diameter of the ring.

Their die cores were all made of hard alloy WCO 8 with the hardness of HRA 88. Their entrance opening 10 of the core was tapered at an angle of 16°, the exit opening 7 was tapered at 40°, dimensions of the bearing zone were 3 and 2.5 mm respectively.

If the outer diameter $D_2$ was given, the inner diameter $d_1$ of the casing 1, was $\delta_1$ shorter.

The mating geometrical feature of the ring and the die core was tapered at an angle of 1.95°.

The two dies were then press-fitted with negative allowance of $\delta_2$. As a result, the die cores were safely assembled in the rings and hardened via 2100 Mpa compression stress exceeding the elastic strength of WCO8 and, thus, they were in a state of deformation favorable for die capability. With higher strength of the casing, press-fitting were safely accomplished.

Evaluation of operational capabilities of the two tested dies in drawing the steel 40 are shown in Table 2.

TABLE 2

| | Metal stock | | | Drawing Condition | | | | |
|---|---|---|---|---|---|---|---|---|
| Tested die | diameter, (mm) | Material | Ovality | lubricant | Drawing speed, (m/min) | Drawed amount, (t) | Drawing force, (t) | Abrasion (mm) |
| 1 | 8.5 | Steel 40 | 0.02 | Neutral soap | 100 | 30 | 0.86 | 0.03 |
| 2 | 7.5 | Steel 40 | 0.003 | Neutral soap | 100 | 38 | 0.6 | 0.045 |

As shown in the table, when 30 t of steel 40 with 8.5 mm diameter was drawn by 7.5 mm die, the core was worn by 0.03 mm in diameter and not fractured. When 38 t of steel 40 with 7.5 mm diameter was drawn by 6.5 mm die, the core was worn by 0.045 mm in diameter and not fractured.

The invention claimed is:

1. A die assembly comprising a die core; at least one pre-stressed ring placed around the die core; and a die casing surrounding the ring, characterized in that the ring is plastically deformed and hardened via compression stress exceeding a material yield limit of the ring, a mating geometric feature of the core and the ring being tapered towards an exit of the die assembly.

2. The die according to claim 1, wherein the die core material is selected from hard alloy, extra hard alloy, nitride, carbide, man-made diamond, or combination of them.

3. The die according to claim 1, wherein the die casing material is selected from steel or alloy steel, its hardness being in the range of HRC 40-55.

4. The die according to claim 1, wherein the pre-stressed ring has the dimensionless thickness $D_2/d_2$ of 1.12-1.3, in which $D_2$ and $d_2$ are respectively outer and inner diameter of the ring.

5. The die according to claim 1, wherein an intermediate ring material is selected preferably from steel, alloy steel, or ferrous/non-ferrous metal alloy of the same strength and plastic deformation characteristics as those of steel or alloy steel, its hardness being in the range of HRC 30-45.

6. The die according to claim 1, wherein the mating geometrical feature on the die core and the ring is tapered at an angle of 1-3°.

7. A method of forming a die assembly according to claim 1 comprising steps of:

a) grinding a tapered outer surface of the die;

b) machining and heat-treating of the ring and the die casing, and grinding or finish-machining of an interface between the casing and the ring;

c) plastically press-fitting the ring to an inner surface of the die casing such that the ring has compression stress exceeding its material yield strength by 10-40%;

d) machining of the inner surface of the ring to a taper fitted to a taper of the die core;

e) press-fitting of the die core to the inner surface of the ring.

8. The method according to claim 7, wherein in step a) the tapered outer surface of the die core is ground to the roughness of Ra 1.25 or more.

9. The method according to claim 7, wherein in step b) the inner surface of the casing and the outer surface of the ring is ground or finish-machined to the roughness of Ra 2.5 or more.

10. The method according to claim 7, wherein in step d) the tapered inner surface of the ring is ground or finish-machined to the roughness of Ra 2.5 or more.

* * * * *